United States Patent [19]

Goursat et al.

[11] Patent Number: 4,480,770

[45] Date of Patent: Nov. 6, 1984

[54] METHOD AND APPARATUS FOR THE PROTECTION OF MOLTEN METAL FLOWS IN FURNACES

[75] Inventors: Albert-Gilbert Goursat, Elancourt-Maurepas; Thierry Hersant, Chatou; Jacques Nicolas, Paris, all of France

[73] Assignee: L'Air Liquide, Societe Anonyme pour l'Etude et l'Exploitation des Procedes Georges Claude, Paris, France

[21] Appl. No.: 294,323

[22] Filed: Aug. 19, 1981

[30] Foreign Application Priority Data

Sep. 15, 1980 [FR] France ..... 80 19837

[51] Int. Cl.[3] ..... B22D 41/00; B22D 41/08

[52] U.S. Cl. ..... 222/590; 222/598; 222/600; 222/603

[58] Field of Search ..... 164/337, 437; 222/590, 222/591, 592, 593, 600, 603, 598

[56] References Cited

U.S. PATENT DOCUMENTS

| | | | |
|---|---|---|---|
| 3,673,039 | 6/1972 | Todd | 222/603 X |
| 3,887,117 | 6/1975 | Fehling . | |
| 3,946,907 | 3/1976 | Berve | 222/561 X |
| 4,131,219 | 12/1978 | Hind et al. | 222/603 |
| 4,178,980 | 12/1979 | Gilbert et al. . | |
| 4,199,087 | 4/1980 | Golas et al. | 222/603 |
| 4,203,538 | 5/1980 | Lührsen | 222/603 |

FOREIGN PATENT DOCUMENTS

| | | | |
|---|---|---|---|
| 0015251 | 9/1980 | European Pat. Off. | 222/603 |
| 2395095 | 6/1977 | France . | |
| 54-20938 | 7/1979 | Japan | 222/603 |
| 387883 | 2/1965 | Switzerland . | |
| 1492533 | 11/1977 | United Kingdom . | |
| 1492534 | 11/1977 | United Kingdom . | |
| 458382 | 3/1975 | U.S.S.R. | 222/603 |

*Primary Examiner*—David A. Scherbel

*Attorney, Agent, or Firm*—Lee C. Robinson, Jr.

[57] ABSTRACT

This invention relates to the protection of the teeming flow or stream of molten metal contained in a vessel and passing through a plate-type valve or cut-off device of the kind comprising a stationary plate and a displaceable plate that is provided with at least one output nozzle. A gas which is substantially inert with respect to the metal and has a pressure slightly higher than atmospheric pressure is fed into the aforesaid device, and this gas surrounds the metal while the latter passes through the said device, in such manner as to isolate the same from the ambient air by an uninterrupted protective gaseous barrier.

6 Claims, 7 Drawing Figures

METHOD AND APPARATUS FOR THE PROTECTION OF MOLTEN METAL FLOWS IN FURNACES

BACKGROUND OF THE INVENTION

The present invention relates to the protection of the teeming stream or flow of a molten metal contained in a vessel and passing through a plate-type valve or cut-off mechanism of the kind comprising a stationary plate and a displaceable plate that is provided with at least one output nozzle.

These valve or cut-off mechanisms control the opening and closing of the outlet of the receiver, foundry ladle, or distributor that contains the molten metal, the output nozzle being arranged to be placeable in communication with outlet. They consequently allow the casting of the molten metal, e.g. steel, into an ingot mould or the like. The casting of the molten metal may be performed directly from the ladle into the ingot mould or, in the case of a continuous casting process, from the ladle into a distributor and thereafter into the ingot mould.

The two plates consist of a material made to resist high temperatures, such as impregnated or resinified ceramic or alumina. The displaceable plate may be slidable or rotatable and may be provided with a single output nozzle or several nozzles differing in internal diameter. In the latter case, the pouring speed may be modified by changing the nozzle, for example in relation to the height of metal in the vessel or container. The two plates may be urged against each other by means of a system of springs provided with a cooling circuit.

It is known moreover that it is of importance to prevent any contact between ambient atmospheric air and molten metal during a teeming or casting operation, to avoid the forming of any of various oxides within the metal mass, these oxides considerably altering the quality of the end product.

The cut-off devices known up to now have numerous points of passage for atmospheric air which is actually drawn in by the suction engendered by the outflow of molten metal. Such valve or cut-off devices increase the risk of air bubble occlusion in the metal during the casting operation and consequently the risks of oxidisation.

The points at which the air reaches the metal are: the gap between the two mutually confronting surfaces of the stationary and displaceable plates, due to the play required for their reciprocal displacement; the area of connection between the nozzle(s) and the displaceable plate, in particular when said nozzle(s) is (are) removably fitted on said plate; the outlet end of the nozzle; the connection between the stationary plate and the container as well as—in the case the nozzles permanently fitted on the displaceable plate—the connection between said nozzle and said plate, these connections being established by "grouting" with a thin mortar which by its nature is only a poor sealant, which offers only a low degree of gas-tightness and becomes increasingly porous as cracks appear after a period of use.

It is an object of the invention substantially to eliminate or minimise the aforesaid disadvantages.

SUMMARY OF THE INVENTION

To achieve this and other objects, the invention provides a process which consists in feeding into the cut-off device a gas which is substantially inert with respect to the metal and has a pressure slightly higher than atmospheric pressure, and in distributing this gas around the metal while it passes through the said device, in such manner as to isolate the said metal from the ambient air by means of a continuous protective gaseous barrier.

A gaseous barrier of this kind opposes the entry of the ambient air and consequently its oxidising action. Moreover, since this gaseous barrier is formed by a gas which is practically inert with respect to the metal processed, that is to say having only a slight, if any, chemical action on this metal, the gaseous barrier raises substantially no risk of itself degrading the quality of the end product.

The inert gas may be fed in between the aforesaid plates and be distributed around the metal by means of a groove cut into one of the plates, said groove communicating with an opening passing through said plate.

Moreover, the inert gas may be fed into the area of connection between the output nozzle and the displaceable plate.

The device as a whole may be isolated by enclosing it in a housing and supplying the housing with inert gas.

Thus, the invention also consists in a plate-type valve or cut-off device comprising gas intake and distribution means connectable to a gas source for providing a gas which is substantially inert with respect to the metal, said means surrounding the metal flowing in said device, in such a manner as to form a gaseous protective barrier between the metal and the ambient air.

The aforesaid intake and distribution elements may comprise at least one recess which is formed in at least one of the plates referred to and is in communication with the gap between the surfaces of the plates which are in mutual contact.

This recess, connected to the source, thus encloses a stock of pressurised inert gas which penetrates into the gap and effectively opposes penetration of the ambient air through that gap.

BRIEF DESCRIPTION OF THE DRAWINGS

In order that the invention may be more clearly understood, reference will now be made to the accompanying drawings which show some embodiments thereof by way of non-limiting example, and in which.

DETAILED DESCRIPTION OF THE DISCLOSED EMBODIMENTS

Figure 1:
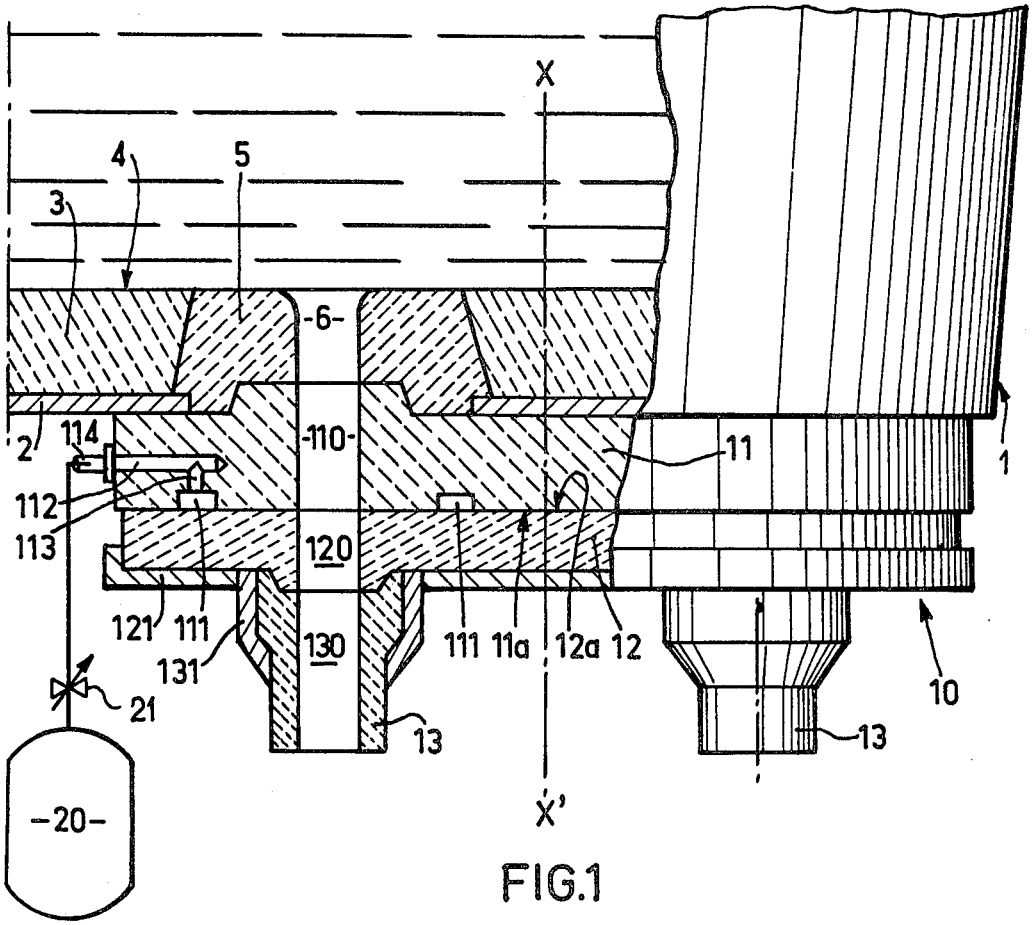
FIG. 1 is a side view, partly in cross-section, of a cut-off device according to a first embodiment of the invention.

Referring now to the drawings, in the embodiment illustrated in FIG. 1, a metal vessel 1, for example a casting ladle, comprising an outer sheath 2 and an internal lining 3 of refractory material, has a base wall provided with a replaceable bushing 5 which also is made of refractory material and in which an outlet 6 is formed. A cut-off device generally indicated at 10 is fitted on this base wall 4 and externally thereof, said device being associated with the outlet 6.

The cut-off device 10 substantially comprises a stationary plate 11 and a displaceable plate 12 the surfaces 11*a* and 12*a* respectively thereof being urged against each other by a system of springs which is not shown, the displaceable plate 12 being arranged to be rotatable around an axis XX' and being provided with two output nozzles 13 which, like the plates 11 and 12 are made of a refractory material, e.g. an impregnated alumina.

An opening 110 located in alignment with the outlet 6, passes through the plate 11, whereas two such passages as 120 (of which one only is shown) pass through the displaceable plate 12. Each nozzle 13 traversed by an internal passage 130 (of which one only is shown), is provided with an outer metal sheath 131 and is permanently installed on the plate 12 by means of said sheath 131 and a fastener 121 forming a unit with the plate 12, in such manner that its passage 130 is aligned with the passage 120. One or the other of the nozzles 13 (in FIG. 1, the nozzle at the left) is placed in communication with the outlet 6 by rotating the plate 12.

The plate 11 is provided with a recess formed by a circular groove 111 cut into its surface 11*a* concentrically with respect to the opening 110 and consequently in communication with the gap 11*a*–12*a* between the two plates. Two intercommunicating passages 112 and 113 at right angles to each other are drilled into the mass of the plate 11. The passage 113 opens directly into the groove 111 whereas the passage 112 is connected via a pipe 114 to a source of pressurised inert gas 20 fitted with a reduction valve 21. The inert gas may be nitrogen, argon, a nitrogen-argon mixture or $CO_2$ if aluminium is the metal under processing for example.

The groove 111 as well as the passages 112 and 113 consequently form intake and distribution elements for the gas supplied by the source 20, this gas forming a gaseous barrier between the two plates 11 and 12 and around the channel formed by the openings 6,110,120 and 130, which prevents ambient air from reaching the flowing metal.

Figure 2:
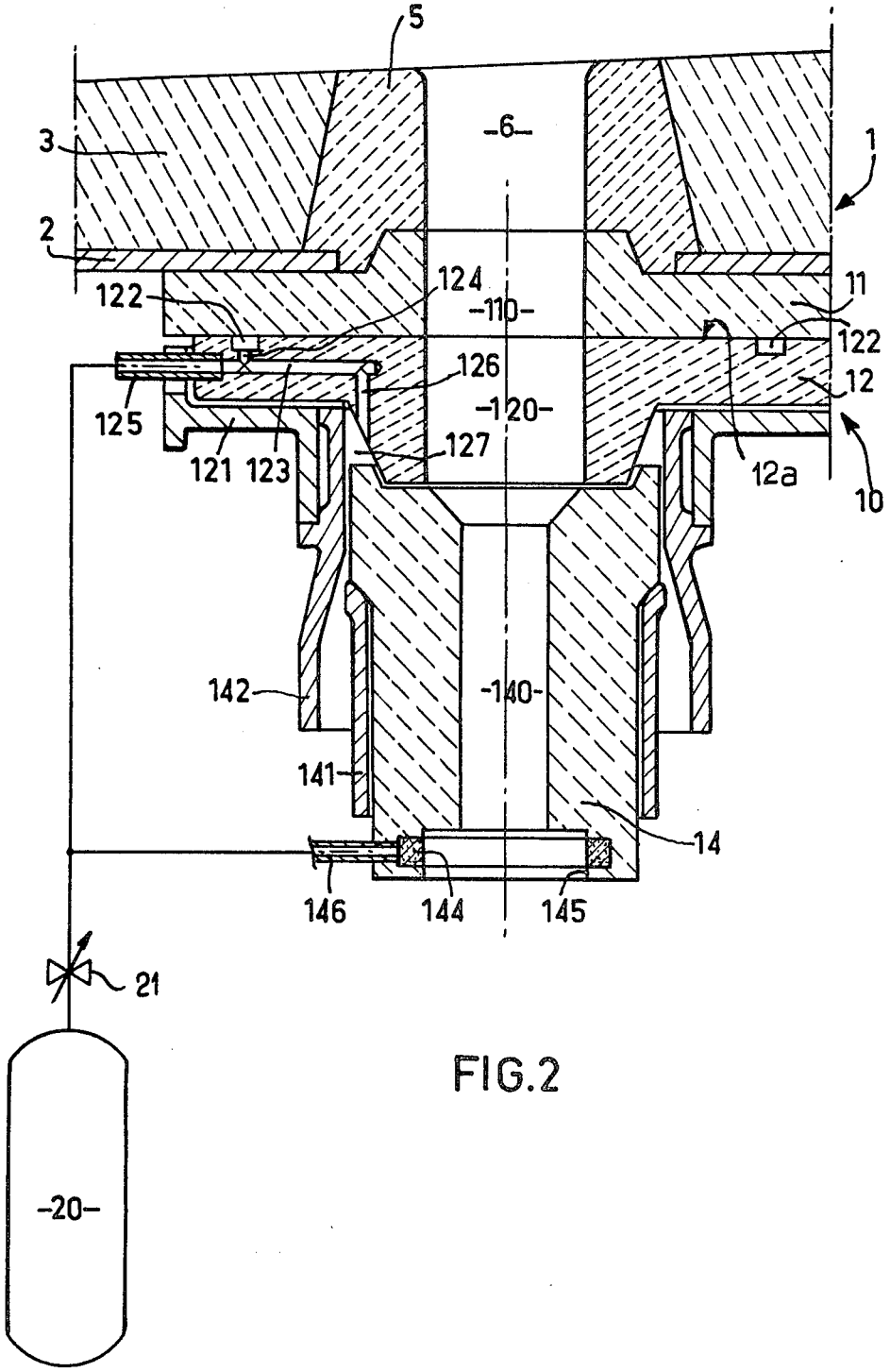
FIG. 2 is a cross-sectional view of part of second embodiment of the invention comprising a nozzle having a protected outlet.

According to the embodiment illustrated in FIG. 2, in which the same reference numerals denote the same elements as in FIG. 1, it is the displaceable plate 12 which is provided with a recess formed by a circular groove 122 cut in its surface 12*a* concentrically with the passage 120 and in communication with the gap between surfaces 11*a*, 12*a* as a result. Two mutually perpendicular intercommunicating passages 123 and 124 are drilled into the mass of the plate 12. The passages 124 opens directly into the groove 122 whereas the passage 123 is connected via a pipe 125 to the source 20. In the case of a displaceable plate bearing several nozzles and consequently several passages such as 120, each of these passages may be provided with a groove like 122, or there may be a single groove surrounding all such passages. In contrast to the nozzle 13 of FIG. 1, the nozzle 14, whose central passage is denoted by 140, is removably fitted on the plate 12 by appropriate means of a known type, for example by a fastening system of the bayonet socket type. To this end, the sheath 141 of the nozzle 14 and the ring 142 carried on the fastener 121, are provided with detent means which secure the nozzle to the plate. The area of connection between this removable nozzle 14 and the plate 12 forming a possible passage for ambient air, a passage 126 is drilled into the plate 12 at right angles to the passage 123 to communicate with the latter, this passage 126 opening into the area of connection 127 between the nozzle and the plate. In these circumstances, the inert gas fills the area 127, thus establishing a further protective barrier around the flowing metal.

The pressure of the inert gas is regulated by means of the reduction valve 21, in such manner as to obtain an overpressure equivalent to a column of a few millimeters of water (1 mm water column$=0.1\times10^{-3}$ atmospheres) as compared to prevailing atmospheric pressure.

In the embodiment of FIG. 2, a protective gaseous barrier is also established at the lower extremity of the nozzle 14, that is, at the outlet of the liquid metal stream. In this case, the inert gas intake and distribution elements comprise an annular distributor formed by a porous annulus of refractory material 144 housed in a terminal recess 145 formed at the outlet of the nozzle 14, this annulus being connected via a pipe 146 to the source 20. The flow of inert gas coming from the ring 144 counterbalances the negative pressure engendered by the discharge at high speed of the metal stream through the passage 140 and prevents atmospheric air from reaching the metal.

Figure 3:
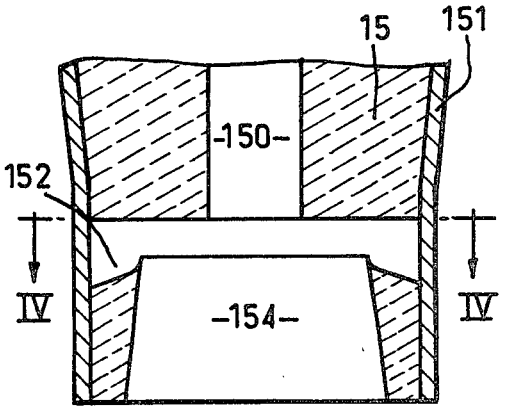
FIG. 3 is a cross-sectional view of part of a first modified form of the aforesaid nozzle having a protected outlet.
Figure 4:
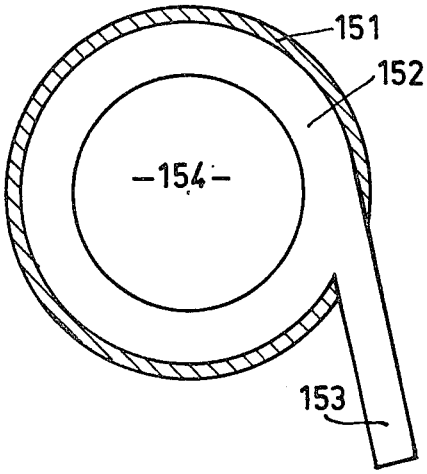
FIG. 4 is a cross-section along the line IV—IV of FIG. 3.

A first modified version of the protective gaseous barrier at the outlet orifice of the nozzle is illustrated in FIGS. 3 and 4. In the case of these Figures, the nozzle 15 having a central passage 150 and a sheath 151, has an annular groove 152 in its lower part into which is tangentially led a pipe 153 connected to a source of pressurised inert gas (not illustrated). The refractory material of which the nozzle is made has a lesser thickness between this groove 152 and the lower extremity of the nozzle, thus forming a passage 154 extending the passage 150 but having a greater diameter. A flow of inert gas enters tangentially with respect to the stream, whose diameter is that of the passage 150, and forms a homogeneous gaseous barrier around the same in the enlarged passage 154. The suction engendered by the metal stream tending to entrain the inert gas, the flow of this latter is preferably controlled in such manner that its infeed occurs at the same speed as that of the liquid metal.

Figure 5:
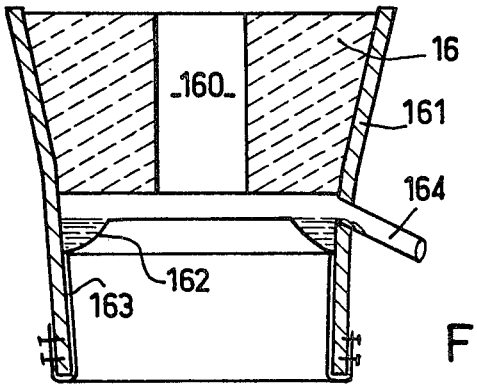
FIG. 5 is a cross-sectional view of part of a second modified form of the nozzle having a protected outlet.

A second modified version of the protective gaseous barrier at the outlet orifice of the nozzle is illustrated in FIG. 5. In the case of this Figure, the nozzle 16 has a central passage 160 and a sheath 161 and also has a distributor in its lower part which is formed by a metal collar 162 which forms a trough around the inner circumference of the nozzle. The collar 162 is extended in the direction of the outlet extremity of the nozzle by a lining or "cuff" 163, also consisting of metal, which forms a covering on the sheath 161, the nozzle being denuded of refractory material in this section. A pipe 164 connected to a source of inert gas in liquefied form (not illustrated) and supplying the said gas in its liquid phase, opens tangentially into the collar 162. The fact that the collar 162 and the cuff or lining 163 are of metal, for example of mild steel, has the result of facilitating the transmission of heat from the metal stream to the liquefied inert gas, and consequently of speeding up the conversion of the gas into its gaseous phase, this latter forming the required protective barrier. The flow of liquefied gas may be controlled in such manner that only a portion is vapourised in the collar 162. The surplus liquefied inert gas then flows along the stream of metal and spreads over its surface, thus continuing to provide protective liquid layer.

Figure 6:
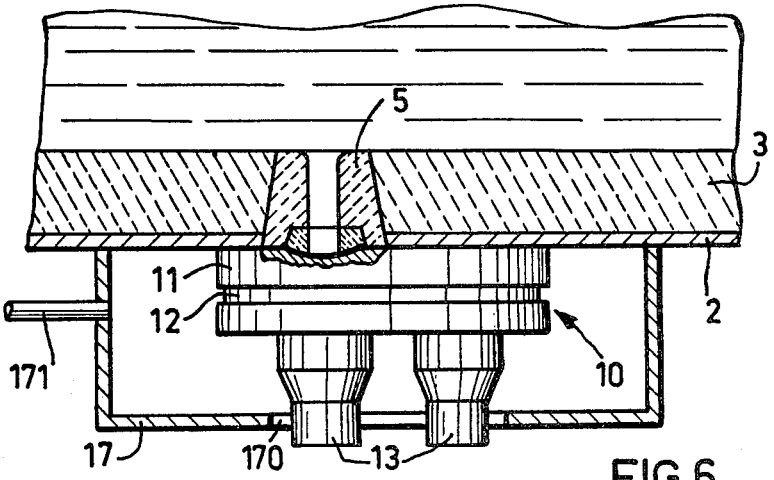
FIG. 6 is a side view partly in cross-section, of a device in accordance with a third embodiment of the invention.
Figure 7:
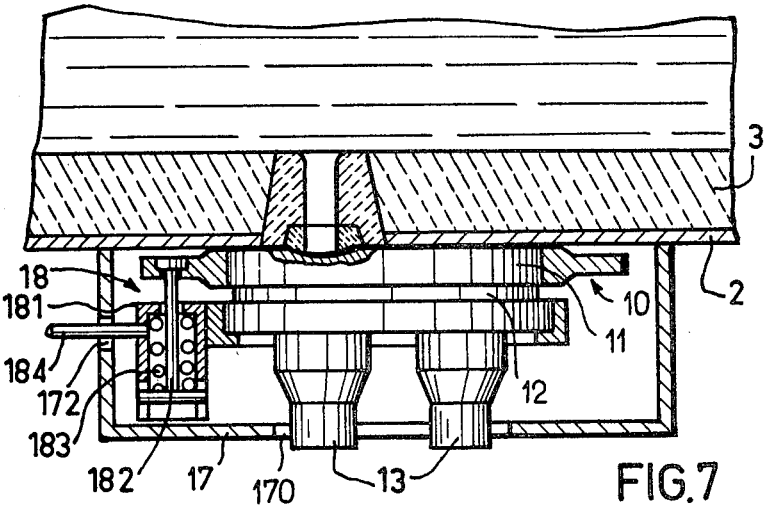
FIG. 7 is a side view of a modified form of the device of FIG. 6.

According to the embodiments of FIGS. 6 and 7, in which the same reference numerals denote the same elements as in the preceding Figures, the device 10 has a metal cover or cap 17 which is fitted hermetically on the base of the vessel and almost completely covers said device, except for an opening 170 which is provided in its lower section for traversal by the nozzles 13 and the flow of the metal stream. This cover 17 is supplied with pressurised inert gas by a source (not illustrated) such as the preceding source 20, and maintains an atmosphere around the device 10 which forms an effective protective barrier against atmospheric air. The gas escapes through the opening 170, thus forming an inert gaseous flow around the nozzles and the metal stream. This cover moreover protects the device 10 against splashes of metal.

In FIG. 6, the device 10 being assumed not to be provided with a system of springs for holding the plates 11 and 12 against each other, and thus not having a cooling circuit, the inert gas is fed directly into the inside of the cover 17 via a pipe 171 which forms a unit therewith.

In FIG. 7, the device 10 is assumed to be provided with a system of springs co-ordinated with a compressed air cooling circuit. This system of springs, which is shown diagrammatically and denoted by reference 18, comprises a stop 181 in the form of an inverted cup which is open at its lower end and forms a unit with the plate 12, a bearing member 182 in the form of a piston unitary with the plate 11, and a spring 183 situated between the stop 181 and the member 182. A pipe 184 allows the feeding of compressed cooling air into the stop 181, this air also flowing via pipes which are not illustrated, into other identical elements of the system of springs. In this case, the pipe 184 is connected to the source of pressurised inert gas and not to a source of compressed air, so that the cover 17 is supplied with the invert gas via the cooling circuit of the system of springs. The cover 17 is equipped with an opening 171 to allow the pipe 184 to pass therethrough.

A variety of modifications may be made to the embodiments described and illustrated without in any way departing from the scope of the invention. For example, the grooves 111 and 112, respectively of the stationary plate 11 and of the displaceable plate 12, may have a non-circular form; for example, they may be elliptical. Similarly, several pipes such as 153 and 164 may lead tangentially into the groove 152 and into the collar 162 of the nozzles 15 and 16 respectively, instead of one only. Considering the breadth of usefulness of the invention for protecting molten metal flows, the terms and expressions that have been employed herein are used as terms of description and not of limitation, and there is no intention in the use of such terms of excluding any equivalents of the features shown and described or portions thereof, but rather it is recognized that various modifications are possible within the scope of the invention as claimed.

What we claim is:

1. A method for protecting a teeming or stream or flow of a molten metal contained in a vessel and passing through a plate-type cut-off device of the kind comprising a stationary plate with an outlet opening therethrough and a displaceable plate that is connected to at least one nozzle at an outlet opening through said displaceable plate, said molten metal passing through said two outlet openings and said nozzle, which method comprises the steps of feeding a gas which is substantially inert with respect to the metal being teemed and has a pressure at least slightly higher than atmospheric pressure between said plates, distributing the gas around the metal while the latter passes through the device, said gas isolating the metal from ambient air by forming a protective gaseous barrier, isolating substantially the whole device by enclosure means including a housing, and supplying said inert gas under pressure to a gas intake port on said housing so that the space between said device and said enclosure means is supplied with said inert gas at a pressure at least slightly higher than atmospheric pressure and said inert gas exits from said enclosure means at said at least one nozzle to form an inert gas shield around said molten metal.

2. A method according to claim 1, wherein an opening in said housing at the area of exit of said molten metal from said nozzle permits the molten metal to exit from said enclosure means and also permits the substantially inert gas within said housing to exit and shield the molten metal exiting said nozzle.

3. A method for protecting a teeming or stream or flow of a molten metal contained in a vessel and passing through a plate-type cut-off device of the kind comprising a stationary plate with an outlet opening therethrough and a displaceable plate that is connected to at least one nozzle at an outlet opening through said displaceable plate, said molten metal passing through said two outlet openings and said nozzle, which method comprises the steps of feeding a gas which is substantially inert with respect to the metal being teemed and has a pressure at least slightly higher than atmospheric pressure between said plates, distributing said gas around the metal while the latter passes through the device, said gas isolating the metal from the ambient air by forming a protective gaseous barrier, and further feeding said insert gas, in the liquid phase, into a collar in the area of exit of said molten metal from said nozzle.

4. A plate-type cut-off device for cutting off the flow of molten metal from the outlet of a vessel, said device comprising a stationary plate and a displaceable plate provided with at least one nozzle, said plates and said nozzle each having at least one opening in communication with said outlet, respective surfaces of said plates being mutually juxtaposed and having at least a small play between said surfaces susceptible to leakage of gas thereat, gas intake and distribution means including a source of a gas which is substantially inert with respect to the molten metal and has a pressure at least slightly higher than atmospheric pressure, said distribution means including a recess constituted by a groove formed in said surface of said displaceable plate and surrounding said at least one opening in said plate in communication with said outlet, said groove being connectable to said source of inert gas via at least one internal passage formed within said displaceable plate, such that said distribution means surrounds the molten metal flowing through said device to establish a gaseous protective barrier between said flowing metal and the ambient air, said distribution means further including conduit means coupled to said at least one internal passage formed within said displaceable plate and connecting to the area of connection between said displaceable plate and said nozzle for distributing said inert gas to said area.

5. A plate-type cut-off device for cutting off the flow of molten metal from the outlet of a vessel, said device comprising a stationary plate and a displaceable plate provided with at least one nozzle, said plates and said nozzle each having at least one opening in communication with said outlet, respective surfaces of said plates being mutually juxtaposed and having at least a small play between said surfaces susceptible to leakage of gas thereat, and gas intake and distribution means including a source of a gas which is substantially inert with respect to the molten metal and has a pressure at least slightly higher than atmospheric pressure, said means including a portion surrounding molten metal flowing in said device, for establishing a gaseous protective barrier between said metal and the ambient air, wherein said intake and distribution means also comprise a cover sheathing said device and provided with at least one opening for discharge of the gas and passage of the molten metal to permit the molten metal to exit, and gas intake means coupled to said source of gas to fill the space between said cover and said device with said substantially inert gas, the at least one opening also serving to permit the substantially inert gas within said cover to flow out to shield the molten metal exiting said nozzle.

6. A plate-type cut-off device for cutting off the flow of molten metal from the outlet of a vessel, said device comprising a stationary plate and a displaceable plate provided with at least one nozzle, said plates and said nozzle each having at least one opening in communication with said outlet, respective surfaces of said plates being mutually juxtaposed and separated by a relatively small gap, and gas intake and distribution means including a source of a gas which is substantially inert with respect to the molten metal and has a pressure at least slightly higher than atmospheric pressure, said means surrounding molten metal flowing in said device, for establishing a gaseous protective barrier between said metal and the ambient air, wherein said intake and distribution means comprise annular distributor means situated close to the area of exit of said molten metal from said nozzle, and means feeding said inert gas, in the liquid phase, to said annular distribution means.

* * * * *